US009331436B2

(12) United States Patent
Kim

(10) Patent No.: US 9,331,436 B2
(45) Date of Patent: May 3, 2016

(54) MULTI-OUTLET CAPABLE OF CONVENIENTLY ORGANIZING CABLES CONNECTED TO ELECTRIC APPLIANCES

(71) Applicant: Nine Bridge, Inc., Uiwang-si, Gyeonggi-do (KR)

(72) Inventor: Sang Yul Kim, Aanyang-si (KR)

(73) Assignee: Nine Bridge, Inc., Uiwang-Si (KR)

( * ) Notice: Subject to any disclaimer, the term of this patent is extended or adjusted under 35 U.S.C. 154(b) by 0 days.

(21) Appl. No.: 14/388,944

(22) PCT Filed: May 21, 2013

(86) PCT No.: PCT/KR2013/004431

§ 371 (c)(1),
(2) Date: Sep. 29, 2014

(87) PCT Pub. No.: WO2013/180418

PCT Pub. Date: Dec. 5, 2013

(65) Prior Publication Data

US 2015/0072552 A1 Mar. 12, 2015

(30) Foreign Application Priority Data

May 29, 2012 (KR) ..... 20-2012-0004481 U

(51) Int. Cl.

| | |
|---|---|
| ***H01R 13/72*** | (2006.01) |
| ***H01R 25/00*** | (2006.01) |
| *H01R 13/70* | (2006.01) |

(52) U.S. Cl.

CPC ..... *H01R 13/72* (2013.01); *H01R 25/003* (2013.01); *H01R 13/70* (2013.01)

(58) Field of Classification Search

CPC ..... H01R 13/60; H01R 13/66; H01R 13/70
USPC ..... 439/501, 502
See application file for complete search history.

(56) References Cited

U.S. PATENT DOCUMENTS 6,666,712 B1 * 12/2003 Kramer

FOREIGN PATENT DOCUMENTS

| | | | |
|---|---|---|---|
| KR | 20-2010-0010493 | U | 10/2010 |
| KR | 10-2010-0127468 | A | 12/2010 |
| KR | 10-2011-0079944 | A | 7/2011 |

OTHER PUBLICATIONS

International Search Report for PCT/KR2013/004431, dated Aug. 29, 2013.

*Primary Examiner* — Briggitte R Hammond
(74) *Attorney, Agent, or Firm* — Sughrue Mion, PLLC

(57) ABSTRACT

Provided is a multi-outlet capable of conveniently organizing cables connected to electric appliances. The provided multi-outlet capable of conveniently organizing cables connected to electric appliances comprises: a plug housing comprising an upwardly opened housing space formed inside for accommodating cables and plugs of electric appliances, downwardly opened cable entry roads formed at a lower portion, inducing holes formed on the bottom for connecting the housing space and the entry roads, and curved arc-shaped apertures formed at the upper ends; a finishing cover insertedly connected to the upper end of the plug housing for finishing the housing space, and having a cable winding drum projected at a lower portion; and a power connection portion embedded in the finishing cover so as to supply electric power to the electric appliances, and comprising a plurality of plug terminals for power supply at all times which is opened toward the housing space to be electrically connected to the plugs accommodated in the housing space, and a plug terminal for power supply at any time which is opened outwardly, individual switches formed at the plug terminals for power supply at all times for controlling the power supplied thereto, a power input cable formed at the outside of the cable winding drum so as to be electrically connected to the terminals for supplying external power, and a main switch formed at the upper portion of the finishing cover to be connected to the power input cable for controlling the power supplied therethrough. It is possible to make the surroundings of a multi-output be neat and improve user convenience.

9 Claims, 6 Drawing Sheets

MULTI-OUTLET CAPABLE OF CONVENIENTLY ORGANIZING CABLES CONNECTED TO ELECTRIC APPLIANCES

CROSS REFERENCE TO RELATED APPLICATIONS

This application is a National Stage of International Application No. PCT/KR2013/004431, filed May 21, 2013, claiming priority from Korean Patent Application No. 20-2012-0004481, filed May 29, 2012, the contents of all of which are incorporated herein by reference in their entirety.

TECHNICAL FIELD

The present invention relates to a multi-outlet, and more particularly, to a multi-outlet for conveniently arranging a remaining cable connected to an electrical product that may enhance a use stability and make surroundings of a multi-outlet be aesthetically neat through an enhancement in a structure of the multi-outlet, and may also achieve an energy saving effect and an enhanced use convenience by externally exposing an individual switch for controlling an operation of a connection terminal and thereby enabling a control operation of the connection terminal to be conveniently performed.

BACKGROUND ART

In general, various types of outlets are used for multiple purposes at home or an office. Here, when a plurality of electrical products, for example, computer devices, electronic devices, heat transfer devices, and kitchen equipment, requiring a power is disposed to be away from a main power outlet installed on a wall, an outlet having a power input end is used to connect the power source to an electrical product.

In particular, a multi-outlet including a single power input end and supplying a power to a plurality of main outlets is generally used to concurrently operate a plurality of devices such as a body and a monitor of a computer system, a printer, and a scanner.

FIG. 1 is a perspective view illustrating a conventional multi-outlet.

Referring to FIG. 1, a conventional multi-outlet 10 includes a switch 20 configured to control an inlet of electricity and a body 30 in which a plurality of plug terminals electrically connected to the switch 20 is aligned in a row.

However, in the conventional multi-outlet, due to fine dust flowing in a plug terminal, a negligent electrical accident frequently occurs.

That is, the conventional multi-outlet is provided in a structure in which a plug terminal is externally exposed and thus, fine dust is stacked within the plug terminal, which causes a short occurrence using the fine dust as a mediator.

Also, in the conventional multi-outlet, cables are intertwined during using the multi-outlet and a surrounding beauty is degraded. That is, in the conventional multi-outlet, cables of various electrical products are concentrated on one place and in this process, remaining cables are untidily spread out on the ground.

DISCLOSURE OF INVENTION

Technical Goals

The present invention is conceived to solve the aforementioned issues found in the conventional multi-outlet and thus, an aspect of the present invention provides a multi-outlet for conveniently arranging a remaining cable connected to an electrical product that may enhance a use stability and make surroundings of a multi-outlet be aesthetically neat through an enhancement in a structure of the multi-outlet, and may achieve an energy saving effect and an enhanced use convenience by externally exposing an individual switch for controlling an operation of a connection terminal and thereby enabling a control operation of the connection terminal to be conveniently performed.

Another aspect of the present invention also provides a multi-outlet for conveniently arranging a remaining cable connected to an electrical product that may maintain surroundings of a multi-outlet to be aesthetically neat by accommodating remaining cables in a housing space during a connection process of electrical products and thereby preventing the remaining cables from being externally exposed.

Another aspect of the present invention also provides a multi-outlet for conveniently arranging a remaining cable connected to an electrical product that may separately provide a regular power supply plug terminal through which a long-time connection operation is performed and an occasional power supply plug terminal externally exposed and through which a frequent connection operation is performed, so as to be selectively used based on a use purpose of an electrical product, and may enhance a use convenience.

Another aspect of the present invention also provides a multi-outlet for conveniently arranging a remaining cable connected to an electrical product that may arrange a remaining cable occurring in a power input cable, configured to supply an external power to a power connector, within a cable winding drum provided in a finishing cover, and thus may further aesthetically perform a cable arranging operation.

Another aspect of the present invention also provides a multi-outlet for conveniently organizing a remaining cable connected to an electrical product that may conveniently open and close a finishing cover by providing an aperture at an upper end of a plug housing, and may also conveniently ventilate a housing space by externally exposing the housing space through the aperture.

Another aspect of the present invention also provides a multi-outlet that enables a remaining cable of an electrical product to enter a housing space through a lower portion of a plug housing and to maintain a contact state with a bottom without floating above the bottom and thereby may minimize an intertwining between the remaining cable and a body or between the remaining cable and another object during controlling the electrical product or a motion using a body.

Technical Solutions

To achieve the aforementioned objects, the present invention according to an aspect provides a multi-outlet for supplying a power to a plurality of electrical products, the multi-outlet including:

a plug housing including an internally formed and upwardly opened housing space for accommodating a remaining cable and a plug of an electrical product, a downwardly opened remaining cable entry road formed in a lower portion of the plug housing, an inducing hole for connecting the housing space and the entry road formed in a bottom of the plug housing, and a curved arc-shaped aperture formed at an upper end of the plug housing;

a finishing cover insertedly connected at an upper end of the plug housing for covering the housing space, and including a cable winding drum projected in a lower portion of the finishing cover; and a power connector including a plurality of regular power supply plug terminals embedded within the finishing cover to supply a power to the electrical product, opened toward the housing space, and electrically connected to a plug accommodated in the housing space, an occasional power supply plug terminal externally opened, an individual switch provided to each regular power supply plug terminal for controlling the power supplied thereto, a power input cable electrically connected to the power supply plug terminals at an outside of the cable winding drum to supply an external power, and a main switch provided in an upper portion of the finishing cover and electrically connected to the power input cable to control the power supplied through the power input cable.

Effects of the Invention

According to embodiments of the present invention, it is possible to prevent a negligent electrical accident from occurring due to fine dust within a connection terminal by preventing the connection terminal electrically connected to an electrical product from being externally exposed and by externally exposing an individual switch for controlling an operation of the connection terminal through an enhancement in a structure of a multi-outlet, and to enhance a use convenience through a convenient operation control.

Also, according to embodiments of the present invention, it is possible to maintain surroundings of a multi-outlet to be aesthetically neat by accommodating a remaining cable of an electrical product in a housing space and by preventing the remaining cable from being externally exposed during using the electrical product.

Also, according to embodiments of the present invention, it is possible to enhance a use convenience by connecting an electrical product requiring a long-time connection use to a regular power supply plug terminal and by connecting an electrical product requiring a short-time connection use to an occasional power supply plug terminal based on a use purpose of an electrical product.

BEST MODE FOR CARRYING OUT THE INVENTION

Hereinafter, a multi-outlet for conveniently arranging a remaining cable connected to an electrical product according to an embodiment of the present invention will be described with reference to the accompanying drawings.

Figure 1:
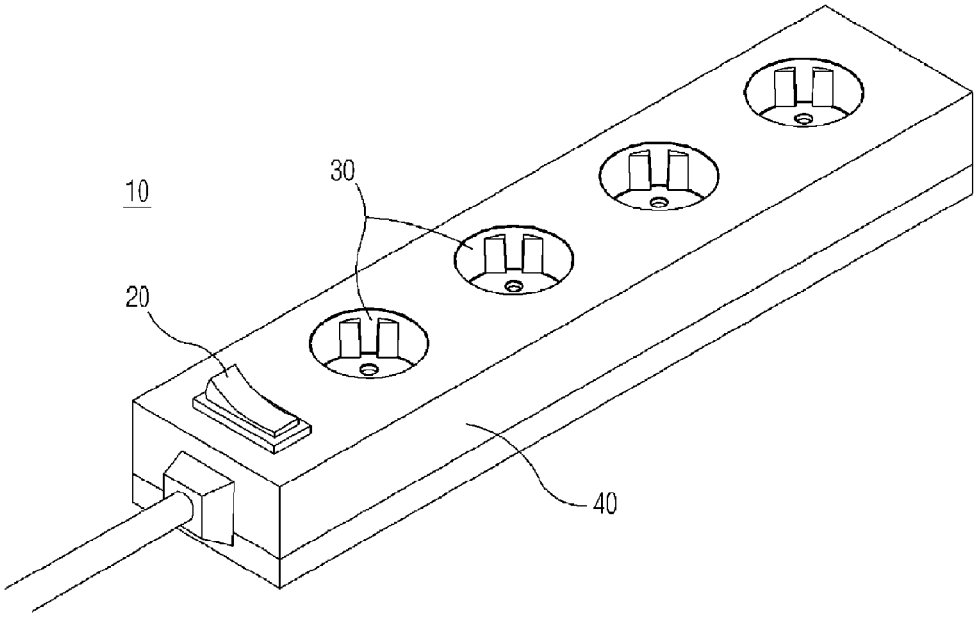
FIG. 1 PRIOR ART
FIG. 1 is a perspective view illustrating a conventional multi-outlet.
Figure 2:
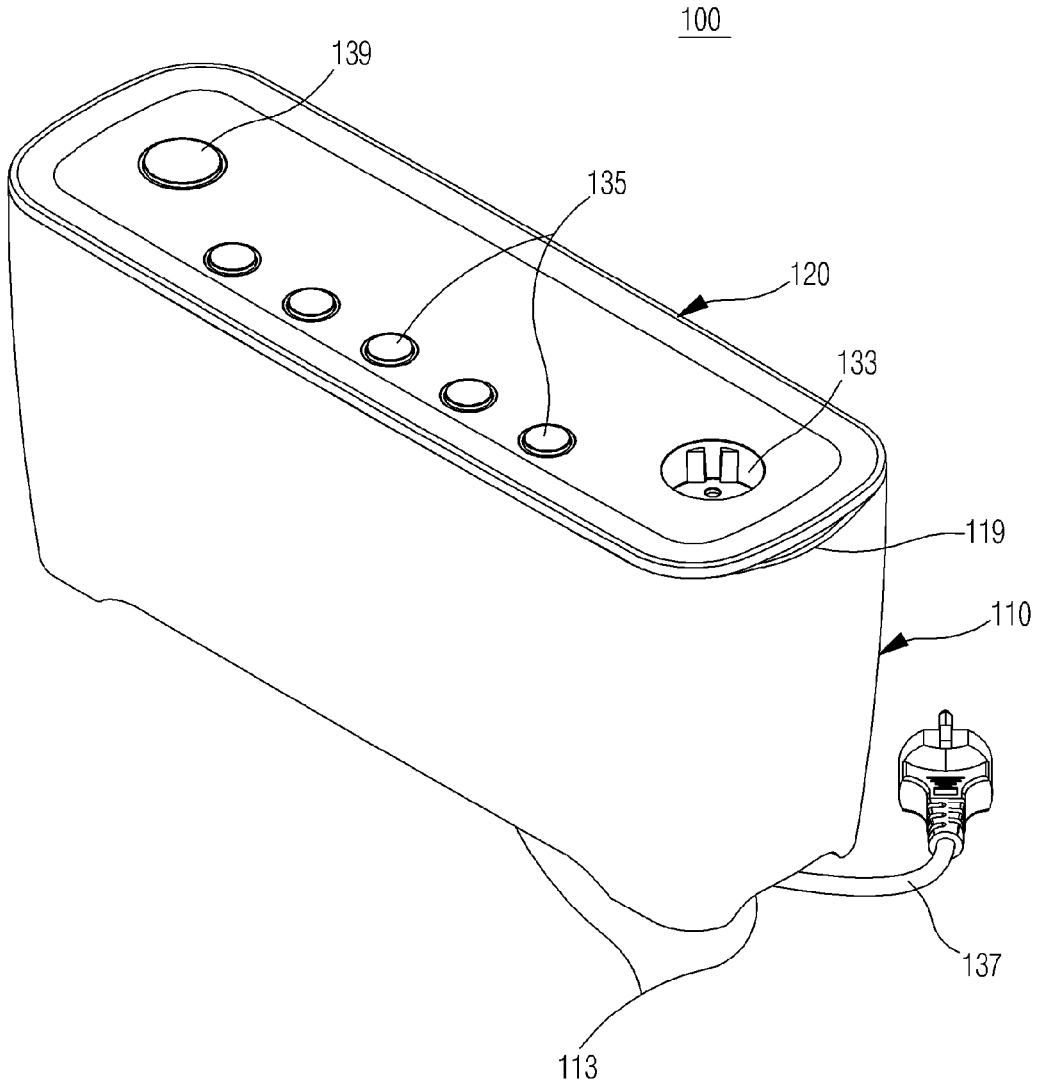
FIG. 2 is a perspective view illustrating a multi-outlet for conveniently arranging a remaining cable connected to an electrical product according to an embodiment of the present invention.
Figure 3:
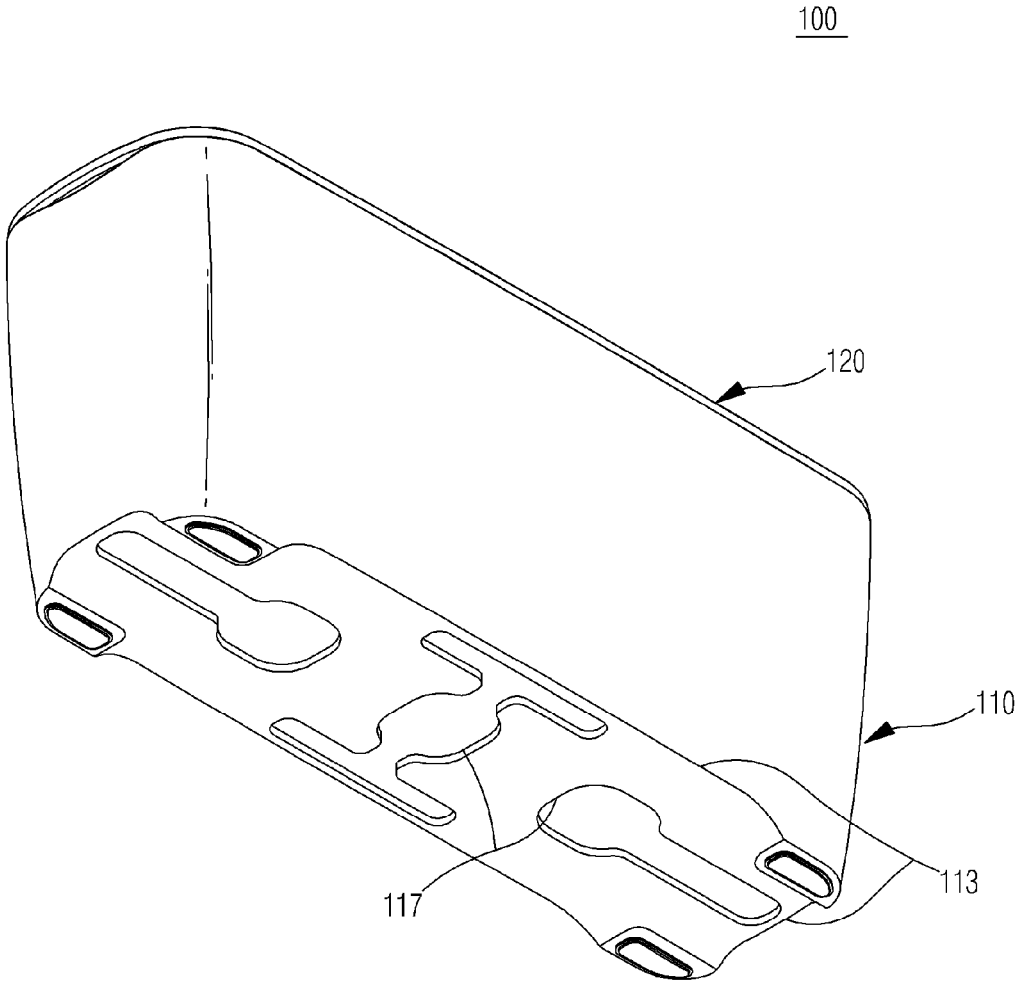
FIG. 3 is a bottom perspective view illustrating a multi-outlet for conveniently arranging a remaining cable connected to an electrical product according to an embodiment of the present invention.
Figure 4:
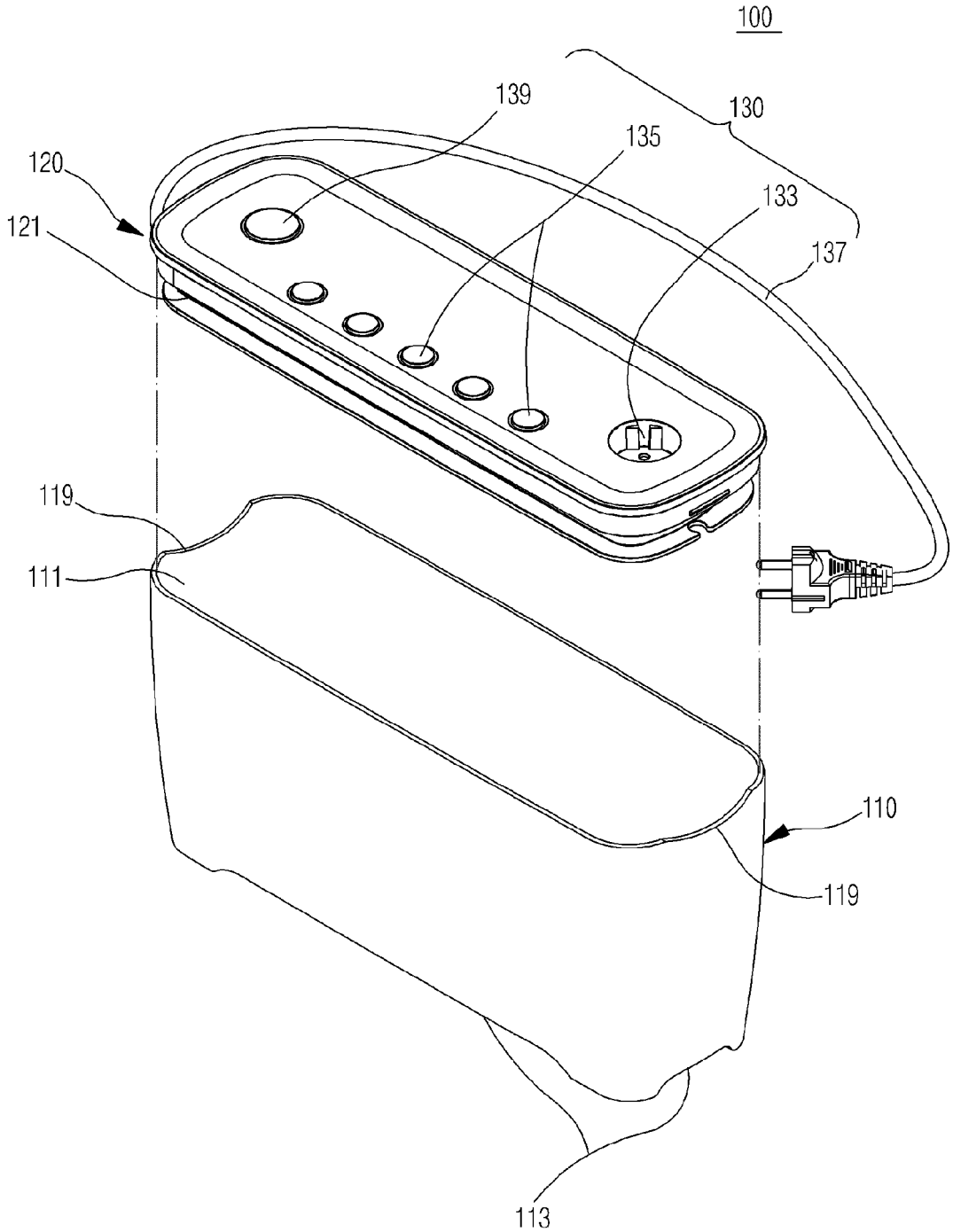
FIG. 4 is an exploded perspective view illustrating a multi-outlet for conveniently arranging a remaining cable connected to an electrical product according to an embodiment of the present invention.
Figure 5:
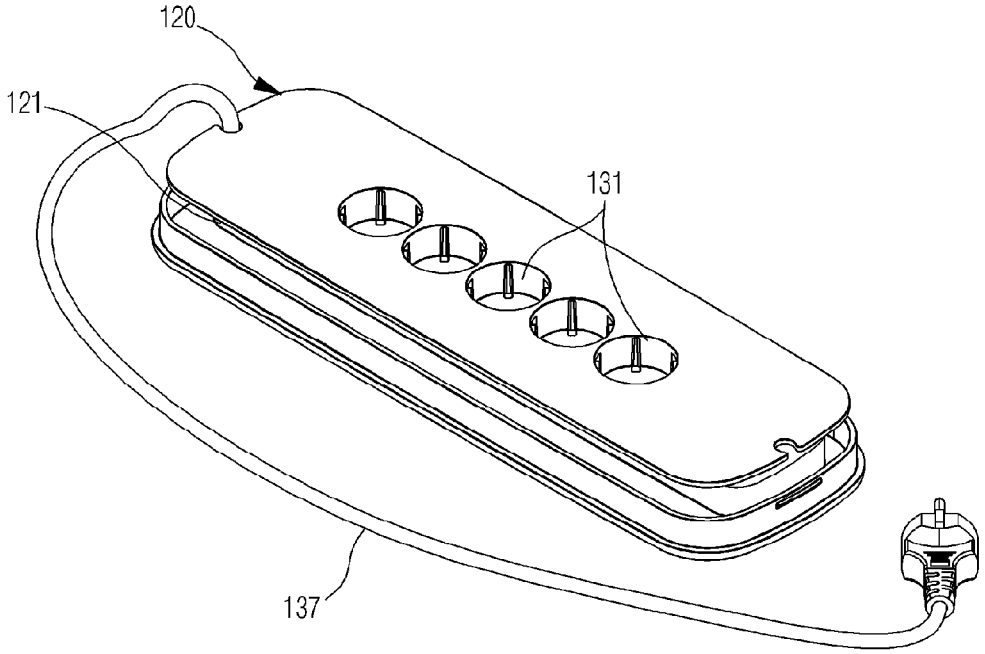
FIG. 5 is a rear perspective view illustrating a finishing cover included in a multi-outlet for conveniently arranging a remaining cable connected to an electrical product according to an embodiment of the present invention.
Figure 6:
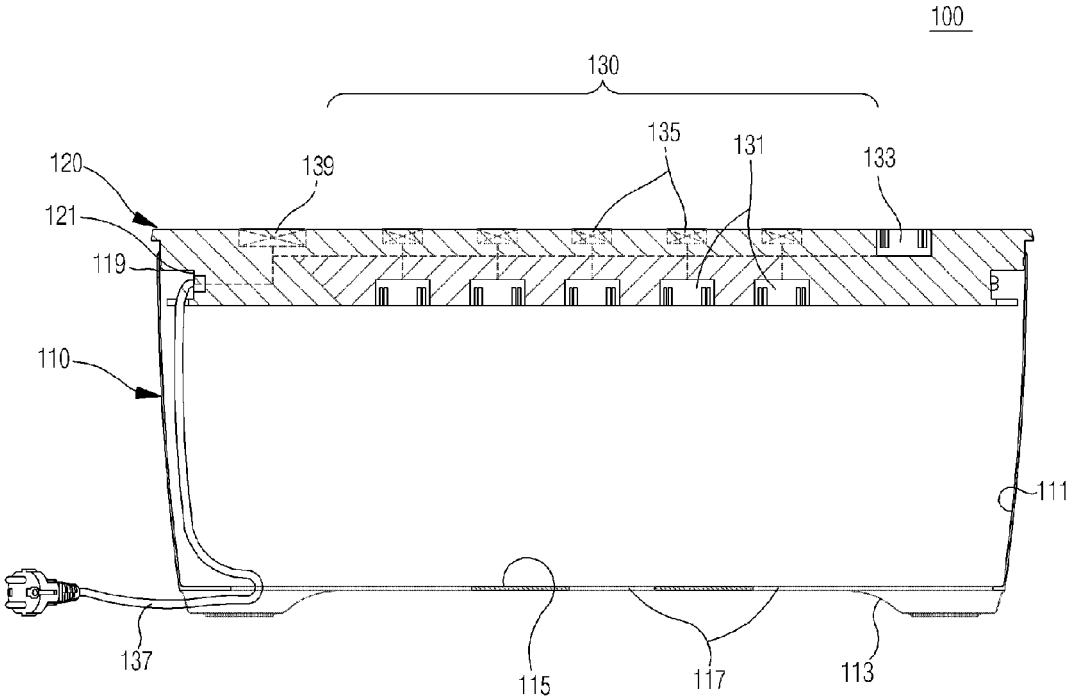
FIG. 6 is a cross-sectional view illustrating principal portions of a multi-outlet for conveniently arranging a remaining cable connected to an electrical product according to an embodiment of the present invention.

FIG. 2 is a perspective view illustrating a multi-outlet for conveniently arranging a remaining cable connected to an electrical product according to an embodiment of the present invention, FIG. 3 is a bottom perspective view illustrating a multi-outlet for conveniently arranging a remaining cable connected to an electrical product according to an embodiment of the present invention, FIG. 4 is an exploded perspective view illustrating a multi-outlet for conveniently arranging a remaining cable connected to an electrical product according to an embodiment of the present invention, FIG. 5 is a rear perspective view illustrating a finishing cover included in a multi-outlet for conveniently arranging a remaining cable connected to an electrical product according to an embodiment of the present invention, and FIG. 6 is a cross-sectional view illustrating principal portions of a multi-outlet for conveniently arranging a remaining cable connected to an electrical product according to an embodiment of the present invention.

Referring to FIGS. 2 through 6, a multi-outlet 100 of the present invention includes a plug housing 110 having an upwardly opened housing space 111, a finishing cover 120 connected to an upper portion of the plug housing 110, and a power connector 130 embedded within the finishing cover 120.

Here, the plug housing 110 is a constituent element that serves to accommodate a remaining cable L and a plug P of an electrical product and to prevent the remaining cable L and the plug P from being externally exposed.

The upwardly opened housing space 111 is formed inside the plug housing 110, and a downwardly opened cable entry road 113 is formed in a lower portion of the plug housing 110. Accordingly, when the plug housing 110 is placed on the ground, lower edges of the plug housing 110 contact with the ground and the cable entry roads 113 are separate from the ground by a predetermined distance.

An inducing hole 117 for connecting the housing space 111 and the entry road 113 is formed in a bottom 115 of the plug housing 110, and a curved arc-shaped aperture 119 is formed at an upper end of the plug housing 110.

Accordingly, an opening and closing operation of the finishing cover 120 may be conveniently performed through the aperture 119. Also, a negligent electrical accident by a heat generation may be prevented through a ventilation of the housing space 111.

Meanwhile, the finishing cover 120 is a constituent element that serves to open and close the housing space 111.

Here, a lower end of the finishing cover 120 is insertedly connected to the housing space 111 at the upper end of the plug housing 110, and a cable winding drum 121 is projected at the lower end of the finishing cover 120.

Accordingly, a multi-outlet of the present invention may make surroundings of the multi-outlet be aesthetically neat, and may prevent an occurrence of a negligent electrical accident by entrance of fine dust by preventing a remaining cable from being externally exposed and by preventing a connection terminal to which a plug is connected from being externally exposed during using the multi-outlet.

Meanwhile, the power connector 130 is a constituent element that serves to connect the plug P accommodated in the plug housing 110 and the plug P present outside the plug housing 110 and to supply the power to the electrical product.

Here, the power connector 130 includes a plurality of regular power supply plug terminals 131 opened toward the housing space 111 and electrically connected to the plug P accommodated in the housing space 111 and an occasional power supply plug terminal 133 opened outside the multi-outlet 100.

Accordingly, by connecting, to the regular power supply plug terminal 131, an electrical product requiring a long-time connection use with respect to the multi-outlet 100 of the present invention, and by connecting, to the occasional power supply plug terminal 133, an electrical product requiring a short-time connection use with respect to the multi-outlet 100 of the present invention, it is possible to enhance a use convenience.

Also, an individual switch 135 is provided to each regular power supply plug terminal 131 for controlling the power supplied thereto. A power input cable 137 is electrically connected to the regular power supply plug terminals 131 and the occasional power supply plug terminal 133 at an outside of the cable winding drum 121 to supply an external power thereto. A main switch 139 is provided in an upper portion of the finishing cover 120 and electrically connected to the power input cable 137 to control the power supplied through the power input cable 137.

Accordingly, by positioning regular power supply plug terminals within a housing space and by externally exposing individual switches for controlling the regular power supply plug terminals, it is possible to conveniently perform a control operation of a connection terminal and to enhance a use convenience. Also, by preventing the power of connection terminals not used, it is possible to enhance an energy saving effect. Also, by separately providing a connection terminal positioned within a multi-outlet and a connection terminal positioned outside the multi-outlet, a user may conveniently use the multi-outlet based on a use purpose of an electrical product. A description related thereto will be made in detail with reference to the accompanying drawings.

Figure 7:
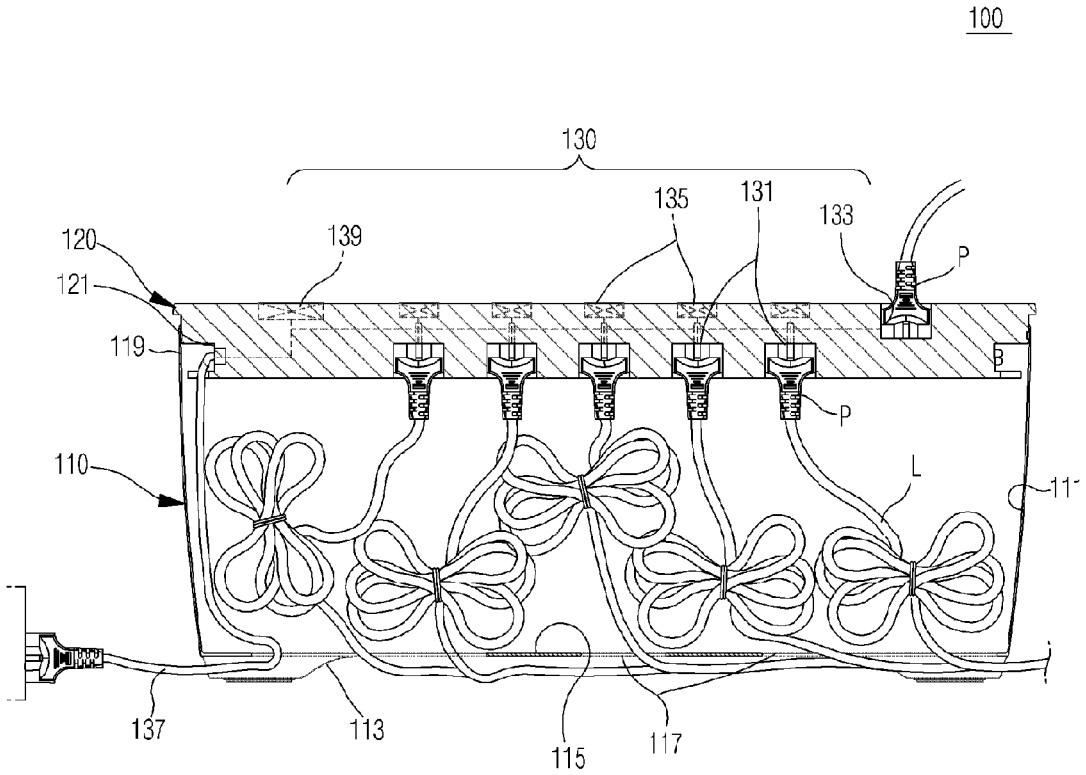
FIG. 7 is a use state view illustrating a multi-outlet for conveniently arranging a remaining cable connected to an electrical product according to an embodiment of the present invention.

FIG. 7 is a use state view illustrating a multi-outlet for conveniently arranging a remaining cable connected to an electrical product according to an embodiment of the present invention.

Referring to FIG. 7, the remaining cable L and the plug P of the electrical product to be connected to the regular power plug terminal 131 is disposed within the housing space 111 through the entry road 113 and the inducing hole 117.

Accordingly, by accommodating the remaining cable L within the housing space 111 and preventing the remaining cable L from being externally exposed during a connection process of the electrical product, surroundings of the multi-outlet 100 are maintained to be aesthetically neat.

Next, the plug P within the housing space 111 is connected to the regular power supply plug terminal 131.

Here, the power to be supplied to the regular power supply plug terminal 131 is controlled through the individual switch 135. That is, when the individual switch 135 is in an ON-state, the power is supplied to the regular power supply plug terminal 131. When the individual switch 135 is in an OFF-state, the power being supplied to the regular power supply plug terminal 131 is cut off.

Next, after verifying a position of the multi-outlet 100 of the present invention and a distance from an external power supply device (not shown), a remaining portion of the power input cable 137 is wound around the cable winding drum 121 and thereby arranged and a required portion of the power input cable 137 is externally wired through the inducing hole 117 and the entry road 113 and thereby connected to the external power supply device.

Accordingly, the power input cable 137 is aesthetically neatly arranged through the cable winding drum 121, and the external power is supplied to the regular power supply plug terminal 131 and the occasional power supply plug terminal 133 through the power input cable 137.

Here, the external power supplied through the power input cable 137 is controlled using the main switch 139. That is, when the main switch 139 is in an ON-state, the external power is supplied through the power input cable 137. When the main switch 137 is in an OFF-state, the external power being supplied through the power input cable 137 is cut off.

Accordingly, the multi-outlet 100 of the present invention enables the overall power control and individual power control using the main switch 139 and the individual switch 135.

The upper end of the plug housing 110 is closed using the finishing cover 120 in a state in which the plug housing 110 is placed on the ground.

Here, the occasional power supply plug terminal 133 is opened toward the outside of the multi-outlet 100. Accordingly, an electrical product requiring a long-time connection use with respect to the multi-outlet 100 of the present invention is electrically connected to the regular power supply plug terminal 131 and thereby used. An electrical product requiring a short-time connection use with respect to the multi-outlet of the present invention is electrically connected to the occasional power supply plug terminal 133 and thereby used. Accordingly, the present invention may enhance a use convenience by selectively employing a connection terminal based on a use purpose of the electrical product.

What is claimed is:

1. A multi-outlet comprising:

a plug housing comprising an internally formed housing space capable of accommodating a cable and a plug of an electrical product;

a finishing cover connected to the plug housing, and configured to open and close the housing space;

at least one regular power supply plug terminal provided on an inner side of the finishing cover; and at least one occasional power supply plug terminal provided on an outer side of the finishing cover, wherein a lower end of the finishing cover is insertedly connected to the housing space at an upper end of the plug housing, and a cable winding drum capable of winding a cable is projected in a lower portion of the finishing cover, wherein the cable winding drum comprises a power input cable electrically connected to the regular power supply plug terminal and the occasional power supply plug terminal to supply an external power, wherein an entry road through which the cable of the electrical product is capable of entering is formed at a lower edge of the plug housing to be separate from the ground by a predetermined distance, and an inducing hole through which the cable of the electrical product is capable of penetrating is formed in a bottom of the plug housing, and wherein the cable and the plug of the electrical product are disposed within the housing space through the entry road and the inducing hole and are connected to the regular power plug terminal.

2. The multi-outlet of claim 1, wherein a curved arc-shaped aperture is formed at an upper end of the plug housing.

3. The multi-outlet of claim 1, wherein the finishing cover comprises a main switch electrically connected to the power input cable to control the power supplied through the power input cable.

4. The multi-outlet of claim 1, wherein the finishing cover comprises an individual switch configured to control the power supplied to each regular power supply plug terminal.

5. A multi-outlet comprising:

a plug housing comprising an internally formed housing space capable of accommodating a cable and a plug of an electrical product;

a finishing cover selectively connected to one side of the plug housing; and a power connector provided to the finishing cover, and configured to connect the plug accommodated in the plug housing and a plug disposed outside the plug housing, wherein a lower end of the finishing cover is insertedly connected to the housing space at an upper end of the plug housing, and a cable winding drum capable of winding a cable is projected in a lower portion of the finishing cover, wherein an entry road through which the cable of the electrical product is capable of entering is formed at a lower edge of the plug housing to be separate from the ground by a predetermined distance, and an inducing hole through which the cable of the electrical product is capable of penetrating is formed in a bottom of the plug housing, wherein the power connector comprises at least one regular power supply plug terminal opened toward the housing space through which a long-time connection operation is performed, and at least one occasional power supply plug terminal opened toward an outside of the plug housing through which a frequent connection operation is performed, and wherein the cable and the plug of the electrical product are disposed within the housing space through the entry road and the inducing hole and are connected to the regular power plug terminal.

6. The multi-outlet of claim 5, wherein a curved arc-shaped aperture is formed at an upper end of the plug housing.

7. The multi-outlet of claim 5, wherein the cable winding drum comprises a power input cable electrically connected to the power connector to supply an external power.

8. The multi-outlet of claim 7, wherein the finishing cover comprises a main switch electrically connected to the power input cable to control the power supplied through the power input cable.

9. The multi-outlet of claim 5, wherein the finishing cover comprises an individual switch configured to control the power supplied to each regular power supply plug terminal.

* * * * *